US010471748B2

(12) United States Patent
Urakami

(10) Patent No.: US 10,471,748 B2
(45) Date of Patent: Nov. 12, 2019

(54) INK JET RECORDING APPARATUS

(71) Applicant: Konica Minolta, Inc., Tokyo (JP)

(72) Inventor: Takeshi Urakami, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/097,890

(22) PCT Filed: May 22, 2017

(86) PCT No.: PCT/JP2017/018969
§ 371 (c)(1),
(2) Date: Oct. 31, 2018

(87) PCT Pub. No.: WO2017/204135
PCT Pub. Date: Nov. 30, 2017

(65) Prior Publication Data

US 2019/0143721 A1 May 16, 2019

(30) Foreign Application Priority Data

May 27, 2016 (JP) ..... 2016-106218

(51) Int. Cl.
*B41J 25/308* (2006.01)
*B41J 2/14* (2006.01)
(Continued)

(52) U.S. Cl.
CPC ..... *B41J 25/308* (2013.01); *B41J 2/14* (2013.01); *B41J 2/155* (2013.01); *B41J 2/175* (2013.01); *B41J 29/38* (2013.01)

(58) Field of Classification Search
CPC ..... B41J 25/001; B41J 29/38; B41J 2/16508; B41J 3/4073; B41J 15/04
(Continued)

(56) References Cited

U.S. PATENT DOCUMENTS 6,419,334 B1 * 7/2002 Akuzawa ..... B41J 25/006 347/37
8,714,725 B2 * 5/2014 Thayer ..... B41J 2/0057 347/102
9,056,502 B2 * 6/2015 Imamura ..... B65H 23/0326

FOREIGN PATENT DOCUMENTS

JP 2013248887 A 12/2013
WO 2015012364 A1 1/2015

OTHER PUBLICATIONS

Written Opinion of the International Searching Authority dated Jul. 11, 2017 from the corresponding International Application No. PCT/JP2017/018969 and English translation.
(Continued)

*Primary Examiner* — An H Do
(74) *Attorney, Agent, or Firm* — Lucas & Mercanti, LLP

(57) ABSTRACT

There is provided an inkjet recording apparatus includes a conveyance unit, a head unit, an attachment member, a fixing member, and a support member. The conveyance unit conveys a recording medium on an outer circumferential curved surface of a cylindrical conveyance drum rotating around a cylindrical shaft. The relative position of the attachment member to the cylindrical shaft is fixed. The head unit has a nozzle ejecting ink and is attached to the attachment member such that the outer circumferential curved surface faces an opening of the nozzle across a predetermined relative distance. The fixing member fixes a fixing portion in the head unit to the attachment member. The fixing portion is between a center of gravity of the head unit and the cylindrical shaft. The support member supports the fixed head unit by applying force which disturbs rotation of the head unit.

12 Claims, 10 Drawing Sheets

(51) Int. Cl.
*B41J 29/38* (2006.01)
*B41J 2/155* (2006.01)
*B41J 2/175* (2006.01)

(58) Field of Classification Search
USPC ..... 347/8, 37, 38, 101, 104
See application file for complete search history.

(56) References Cited

OTHER PUBLICATIONS

International Search Report dated Jul. 11, 2017 for PCT/JP2017/018969 and English translation.

* cited by examiner

INK JET RECORDING APPARATUS

CROSS REFERENCE TO RELATED APPLICATION

This Application is a 371 of PCT/JP2017/018969 filed on May 22, 2017 which, in turn, claimed the priority of Japanese Patent Application No. 2016-106218 filed on May 27, 2016, both applications are incorporated herein by reference.

TECHNOLOGICAL FIELD

The present invention relates to an inkjet recording apparatus.

BACKGROUND ART

Conventionally, there is an inkjet recording apparatus which ejects ink from nozzles to record an image on a recording medium conveyed by a conveyance unit. The nozzles are arranged in a head unit over an image recording range in the width direction, which is orthogonal to the conveying direction of the recording medium. In such an inkjet recording apparatus, a color image may be recorded by using multiple head units which each eject ink of different colors from nozzles.

Further, there is an inkjet recording apparatus having a conveyance unit which places a recording medium on the outer circumferential curved surface of a cylindrical conveyance drum and conveys the recording medium by rotating the conveyance drum around the cylindrical shaft. Patent document 1 discloses an inkjet recording apparatus which records an image by using such a conveyance unit and multiple head units. In such an inkjet recording apparatus, the head units are arranged to be inclined, radially from the cylindrical shaft of the conveying drum, so that nozzle surfaces provided with nozzle openings in each of the head units is substantially in parallel with and facing the outer peripheral curved surface of the conveyance drum. In the inkjet recording apparatus according to Patent Document 1, the head units each have fixing portions which are fixed to predetermined attachment members. The fixing portions are at two portions respectively near both ends in the longitudinal direction of the bottom surface having the nozzle surfaces.

With such arrangement, it is possible to reduce variation in the distances from the openings of the respective nozzles on the nozzle surfaces to the outer circumferential curved surface of the conveyance drum, so that the ink ejected from each of the nozzles lands at an appropriate position of the conveyed recording medium.

PRIOR ART DOCUMENT

Patent Document

[Patent Document 1] Japanese Patent Application Laid Open Publication No. 2013-248887

SUMMARY

Problems to be Solved by the Invention

However, since each head unit is arranged to be inclined in the conventional inkjet recording apparatus, the center of gravity of the head unit and the fixing portions near the nozzle surfaces of the head unit are shifted with respect to a horizontal-distance direction which is in a horizontal plane and perpendicular to the cylindrical shaft. Such a head unit having the center of gravity shifted from the fixing portion with respect to the horizontal-distance direction may tilt or deflect due to moment to rotate the head unit generated by gravity. This results in fluctuation of the distance between the nozzle surfaces and the outer circumferential curved surface and in inappropriate land positions of ink ejected from the nozzles. There is a problem that the image quality of recorded image is deteriorated.

An object of the present invention is to provide an inkjet imaging apparatus which can suppress fluctuation of the distance from the nozzle surface to the outer circumferential curved surface of the conveyance drum.

Means for Solving the Problem

In order to achieve at least one of the above objects, according to one aspect of the invention, there is provided an inkjet recording apparatus including:

a conveyance unit which has a cylindrical conveyance drum on an outer circumferential curved surface of which is mounted a recording medium, and conveys the recording medium by rotation of the conveyance drum around a cylindrical shaft;

a head unit which has a nozzle ejecting ink onto the recording medium which is conveyed;

an attachment member whose relative position to the cylindrical shaft is fixed and to which the head unit is attached such that the outer circumferential curved surface of the conveyance drum faces an opening across a predetermined relative distance, the opening of the nozzle being formed on a nozzle surface in the head unit;

a fixing member which fixes a fixing portion in the head unit to the attachment member, the fixing portion being positioned between a center of gravity of the head unit and the cylindrical shaft in a direction which is in a horizontal plane and perpendicular to the cylindrical shaft; and a support member which applies force to the head unit fixed to the attachment member and supports the head unit, the force being in a direction to disturb rotation of the head unit due to gravity.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

EMBODIMENT FOR CARRYING OUT THE INVENTION

Hereinafter, one or more embodiments according to an inkjet recording apparatus of the present invention is explained with reference to the drawings. However, the scope of the invention is not limited to the disclosed embodiments.

Figure 1:
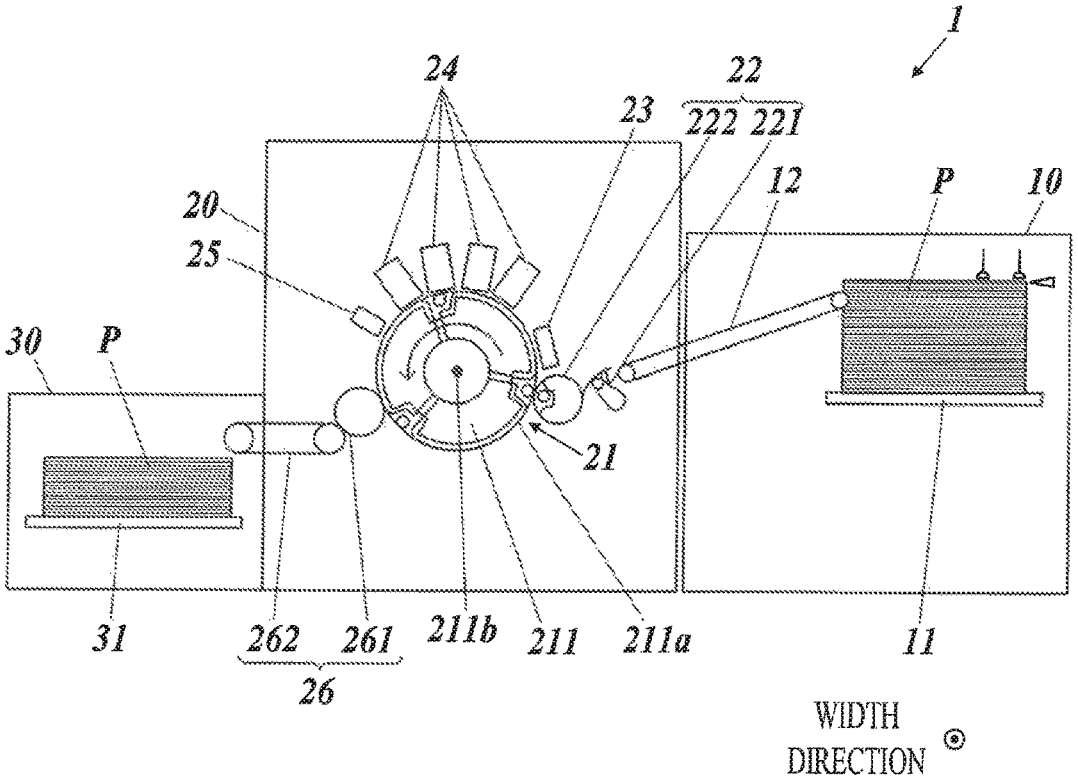
FIG. 1 is an overview of an inkjet recording apparatus.

FIG. 1 is an overview of an inkjet recording apparatus of an embodiment according to the present invention.

Figure 3:
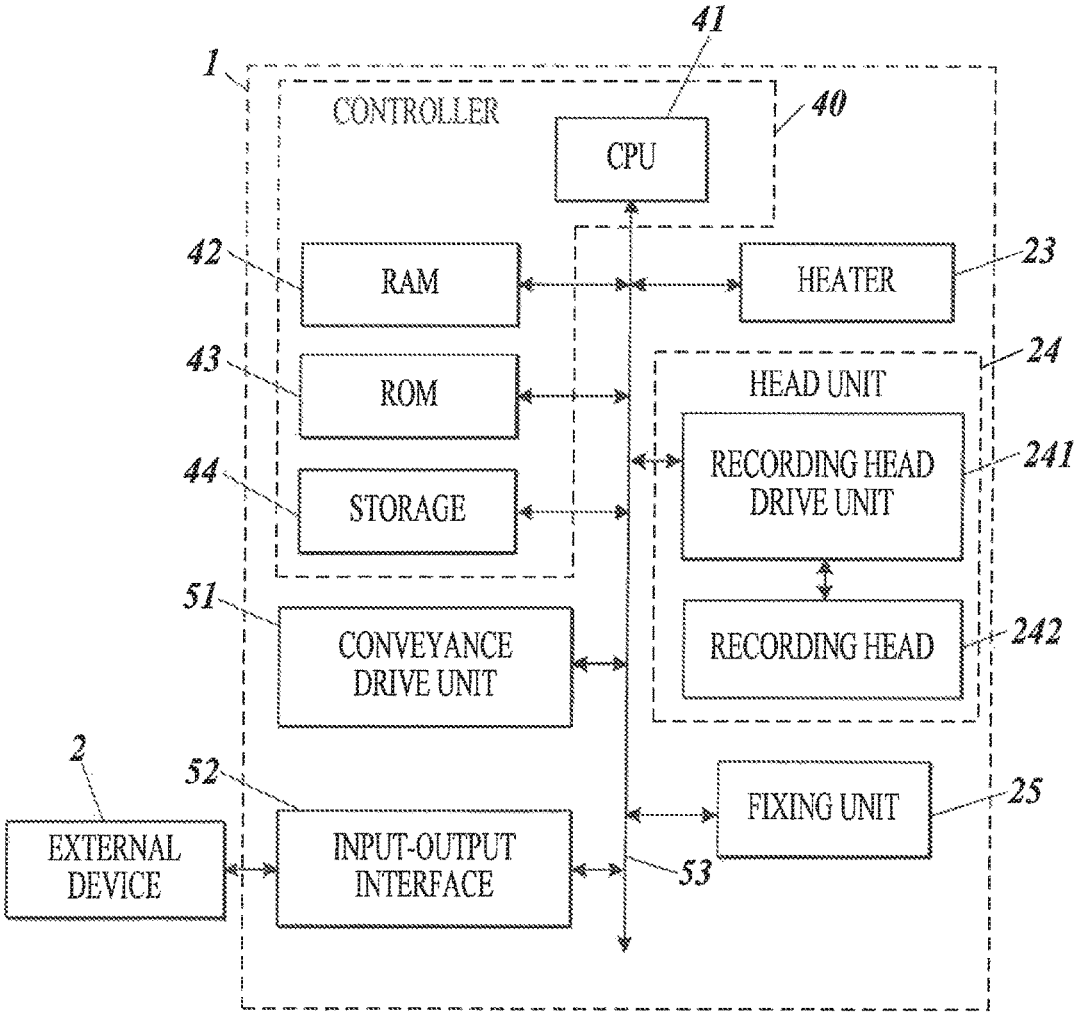
FIG. 3 is a block view showing a main functional structure of an inkjet recording apparatus.

The inkjet recording apparatus 1 includes a sheet feeder 10, an image former 20, a sheet receiver 30, and a controller 40 (see FIG. 3). Under the control of the controller 40, the inkjet recording apparatus 1 conveys a recording medium P stored in the sheet feeder 10 to the image former 20, records an image on the recording medium P in the image former 20, and conveys the recording medium P on which the image is recorded to the sheet receiver 30. As the recording medium P can be used a variety of medium on whose surface ink can be fixed, such as fabric and sheet resin as well as paper such as normal paper and coated paper.

The sheet feeder 10 includes a sheet feeding tray 11 for storing the recording medium P and a medium feeder 12 for conveying and feeding the recording medium P from the sheet feeding tray 11 to the image former 20. The medium supply feeder 12 includes a ring belt supported by two rollers from inside and conveys the recording medium P from the sheet feeding tray 11 to the image former 20 by rotating the rollers while the recording medium P is mounted on the belt.

The image former 20 includes a conveyance unit 21, a first delivery unit 22, a heater 23, head units 24, a fixing unit 25, a second delivery unit 26, and the like.

The conveyance unit 21 holds the recording medium P mounted on an outer circumferential curved surface 211*a* (a conveyance surface) of a cylindrical conveyance drum 211. The conveyance drum 211 rotates around a cylindrical shaft 211*b* (a rotation shaft) of the conveyance drum extending horizontally, in a direction perpendicular to the drawing in FIG. 1, and thereby conveys the recording medium P on the conveyance drum 211 in the conveyance direction. The conveyance drum 211 has not-shown claws and a not-shown suction device for holding the recording medium P on the outer circumferential curved surface 211*a*. The claws press ends of the recording medium P and the suction device attracts the recording medium P to the outer circumferential curved surface 211*a*, so that the recording medium P is held on the outer circumferential curved surface 211*a*. The conveyance unit 21 includes a not-shown conveyance drum motor for rotating the conveyance drum 211. The conveyance drum 211 rotates in an angle proportional to the rotation amount of the conveyance drum motor.

The first delivery unit 22 delivers, to the conveyance unit 21, the recording medium P conveyed by the medium supply unit 12 of the sheet feeder 10. The first delivery unit 22 arranged between the medium supply unit 12 of the sheet feeder 10 and the conveyance unit 21 holds and takes up, with a swing arm 221, one end of the recording medium P conveyed from the medium supply unit 12, and delivers, via a delivery drum 222, the recording medium P to the conveyance unit 21.

The heater 23 is disposed between an arrangement position of the delivery drum 222 and an arrangement position of the head units 24, and heats the recording medium P conveyed by the conveyance unit 21 so as to be within a predetermined temperature range. The heater 23 includes, for example, an infrared heater, and generates heat by applying current to the infrared heater on the basis of control signals from CPU 41 (FIG. 3).

Each head unit 24 has a nozzle surface exposed to the outside which is provided with nozzle openings for ejecting ink. The head unit 24 records an image by ejecting ink onto the recording medium P from the nozzle openings on the nozzle surface facing the outer circumferential curved surface 211*a* of the conveyance drum 211 at an appropriate timing according to the rotation of the conveyance drum 211 on which the recording medium P is held. The head unit 24 is arranged so that the openings on the nozzle surface are separated from the outer circumferential curved surface 211*a* by a predetermined distance. In the inkjet recording apparatus 1 according to this embodiment, four head units 24 each corresponding to ink of four colors, yellow (Y), magenta (M), cyan (C), and black (K), are arranged at predetermined intervals in a color order of Y, M, C, and K from the upstream side in the conveying direction of the recording medium P.

Each head unit 24 constitutes a carriage 60 (FIG. 4) together with a stay 61 (FIG. 4) and the like, however, components of the carriage 60 other than the head units 24 are omitted in FIG. 1.

Figure 2:
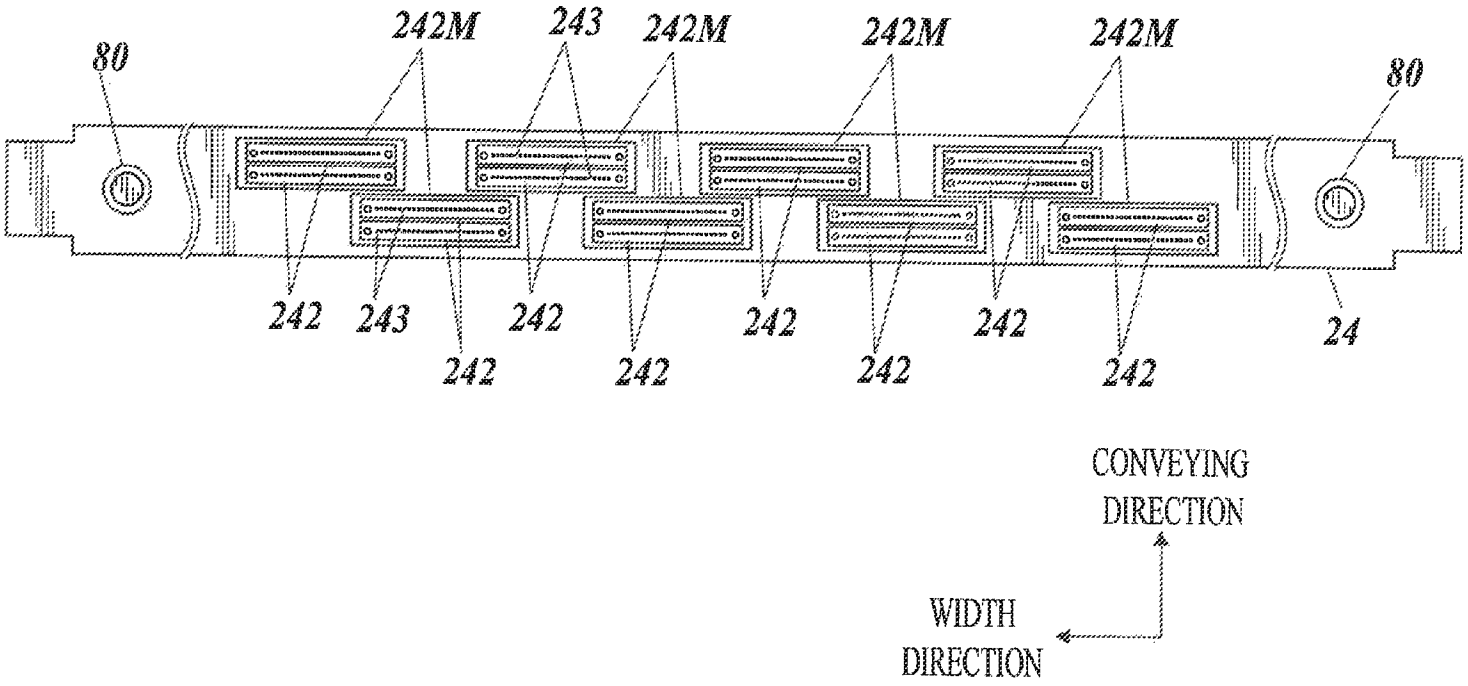
FIG. 2 is a schematic view of a structure of a head unit.

FIG. 2 is a schematic view of a structure of the head unit 24. FIG. 2 is a plan view of the entire head unit 24 viewed from the side facing the outer circumferential curved surface 211*a* of the conveyance drum 211, that is, from the bottom side provided with nozzle surfaces 24*f*.

The head unit 24 of the present embodiment includes sixteen recording heads 242 in which multiple recording elements for ejecting ink are arranged in the cylindrical shaft direction of the conveyance drum 211 (that is, in the width direction orthogonal to the conveying direction). The recording elements of the recording head 242 each have a pressure chamber for storing ink, a piezoelectric element provided on the wall of the pressure chamber, and nozzles 243. When driving signal(s) for deforming the piezoelectric element(s) is input to the recording element(s), deformation of the piezoelectric element(s) causes deformation of the pressure chamber(s) and varies pressure in the pressure chamber(s). The recording element(s) thereby performs ink ejection operation from the nozzles 243 communicating with the pressure chamber(s).

In FIG. 2, the positions of the openings of the nozzles 243 are shown on the nozzle surfaces of the recording heads 242. The arrangement direction of the recording elements in each recording head 242 is not limited to the width direction which is orthogonal to the conveying direction, but may be a direction which crosses the conveying direction at an angle other than the right angle.

In the head unit 24, head modules 242M are each constituted with the two recording heads 242 arranged adjacent to each other in the conveying direction such that the nozzles 243 of the recording elements are alternately arranged in the width direction. Due to such an arrangement of the nozzles 243, recording with a resolution of 1200 dpi (dot per inch) in the width direction is possible by the head modules 242M. The eight head modules 242M are each engaged with openings formed in the substrate 24*a*, such that the nozzle surfaces 24*f* of the recording heads 242 are exposed from one surface perpendicular to the thickness direction of the substrate 24*a*. A line head is constituted by the eight head modules 242M arranged in a positional relationship in which ranges for ejecting ink from the nozzles 243 are continuous in the width direction, that is, in a staggered pattern in which the ranges are arranged so as to overlap with each other in the width direction.

Further, a pair of engaging portions 80 (a first fixing portion, a second fixing portion) used for fixing the head unit 24 is provided in the vicinity of both ends in the width direction of the substrate 24*a*, that is, one side and the other side of the arrangement range of the nozzles 243 in the width direction. The fixing mechanism of the head unit 24 by the engaging portions 80 will be described later.

The arrangement range of the nozzles 243 included in the head unit 24 in the width direction covers the width in the width direction of the image-recordable area on the recording medium P conveyed by the conveyance belt 13. The head unit 24 is used at a fixed position in image recording, and records an image by a single-pass method in which ink is sequentially ejected onto different positions in the conveying direction at predetermined intervals (at conveying direction intervals) in accordance with the conveyance of the recording medium P.

As the ink ejected from the nozzles 243 of the recording elements, for example, one whose phase changes between gel and sol according to temperature and which is cured by irradiation with energy rays, such as ultraviolet rays, may be used.

In the present embodiment is used ink which is gel at room temperature and becomes sol by heating. The head unit 24 includes an ink tank 24*g* (FIG. 7B) which stores the ink and a not-shown ink heater which heats the ink supplied from the ink tank 24*g* to the recording heads 242. The ink heater heats the ink, under the control of the CPU 41, to a temperature at which the ink becomes sol. The recording heads 242 eject the ink heated into a sol state. When the ink in a sol state is ejected onto the recording medium P, ink droplets are naturally cooled after landing on the recording medium P, so that the ink is rapidly solidified on the recording medium P and becomes gel.

The fixing unit 25 has an energy ray emitter(s) arranged over the width of the conveyance unit 21 in the width direction. The fixing unit 25 cures and fixes the ink ejected onto the recording medium P by energy rays such as ultraviolet rays emitted from the energy ray emitter(s) to the recording medium P placed on the conveyance unit 21. The energy ray emitters of the fixing unit 25 are arranged facing the outer circumferential curved surface 211*a* between the arrangement position of the head units 24 and the arrangement position of a delivery drum 261 of the second delivery unit 26.

The second delivery unit 26 has a belt loop 262 having a ring-shaped belt and the cylindrical delivery drum 261 which delivers the recording medium P from the conveyance unit 21 to the belt loop 262. The inner face of the belt is supported by two rollers. The second delivery unit 26 conveys the recording medium P received from the conveyance unit 21 by means of the delivery drum 261 onto the belt loop 262, and ejects the recording medium P to the sheet receiver 30.

The sheet receiver 30 has a plate-shaped sheet receiving tray 31 on which the recording medium P ejected from the image former 20 by the second delivery unit 26 is placed.

FIG. 3 is a block view showing a main functional structure of the inkjet recording apparatus 1.

The inkjet recording apparatus 1 includes the heater 23, the head unit(s) 24 having recording a head drive unit 241 and the recording head(s) 242, the fixing unit 25, the controller 40, a conveyance drive unit 51, an input-output interface 52, and a bus 53.

The recording head drive unit 241 supplies drive signals to the recording elements of the recording heads 242 at appropriate timings for deforming the piezoelectric elements according to image data, and thereby causes the nozzle(s) 243 of the recording head(s) 242 to eject ink in an amount corresponding to pixel values of the image data.

The controller 40 has the CPU 41 (Central Processing Unit), a RAM 42 (Random Access Memory), a ROM 43 (Read Only Memory), and a storage 44.

The CPU 41 reads programs for various types of control and setting data stored in the ROM 43, stores the programs and setting data in the RAM 42, and executes the programs and thereby performs various types of arithmetic processing. The CPU 41 controls the whole operation of the inkjet recording apparatus 1.

The RAM 42 provides the CPU 41 with a memory space for work and stores temporary data. The RAM 42 may contain a nonvolatile memory.

The ROM 43 stores the programs for various types of control executed by the CPU 41, the setting data, and so forth. Instead of the ROM 43, a rewritable nonvolatile memory, such as an EEPROM (Electrically Erasable Programmable Read Only Memory) or a flash memory, may be used.

The storage 44 stores print jobs (image recording commands) input from an external device 2 via the input-output interface 52, and image data on an image to be recorded which is relevant to the print jobs. As the storage 44, for example, an HDD (Hard Disk Drive) is used, and a DRAM (Dynamic Random Access Memory) or the like may be used in combination.

The conveyance drive unit 51 supplies drive signals to the conveyance drum motor for the conveyance drum 211 on the basis of control signals supplied from the CPU 41, and rotates the conveyance drum 211 at a predetermined speed and timings. The conveyance drive unit 51 also supplies, on the basis of control signals supplied from the CPU 41, drive signals to motors which cause the medium supply unit 12, the first delivery unit 22 and the second delivery unit 26 to operate, so that the recording medium P is supplied to and ejected from the conveyance unit 21.

The input-output interface 52 mediates data exchange between the external device 2 and the controller 40. The input-output interface 52 is constituted of, for example, one or a combination of a variety of serial interfaces and a variety of parallel interfaces.

The bus 53 is a path for the controller 40 and the other components to exchange signals.

The external device 2 is, for example, a personal computer, and supplies the print jobs, the image data, and so forth, to the controller 40 via the input-output interface 52.

Next, the structure relevant to movement and fixing of the head units 24 in the inkjet recording apparatus 1 will be explained.

Figure 4:
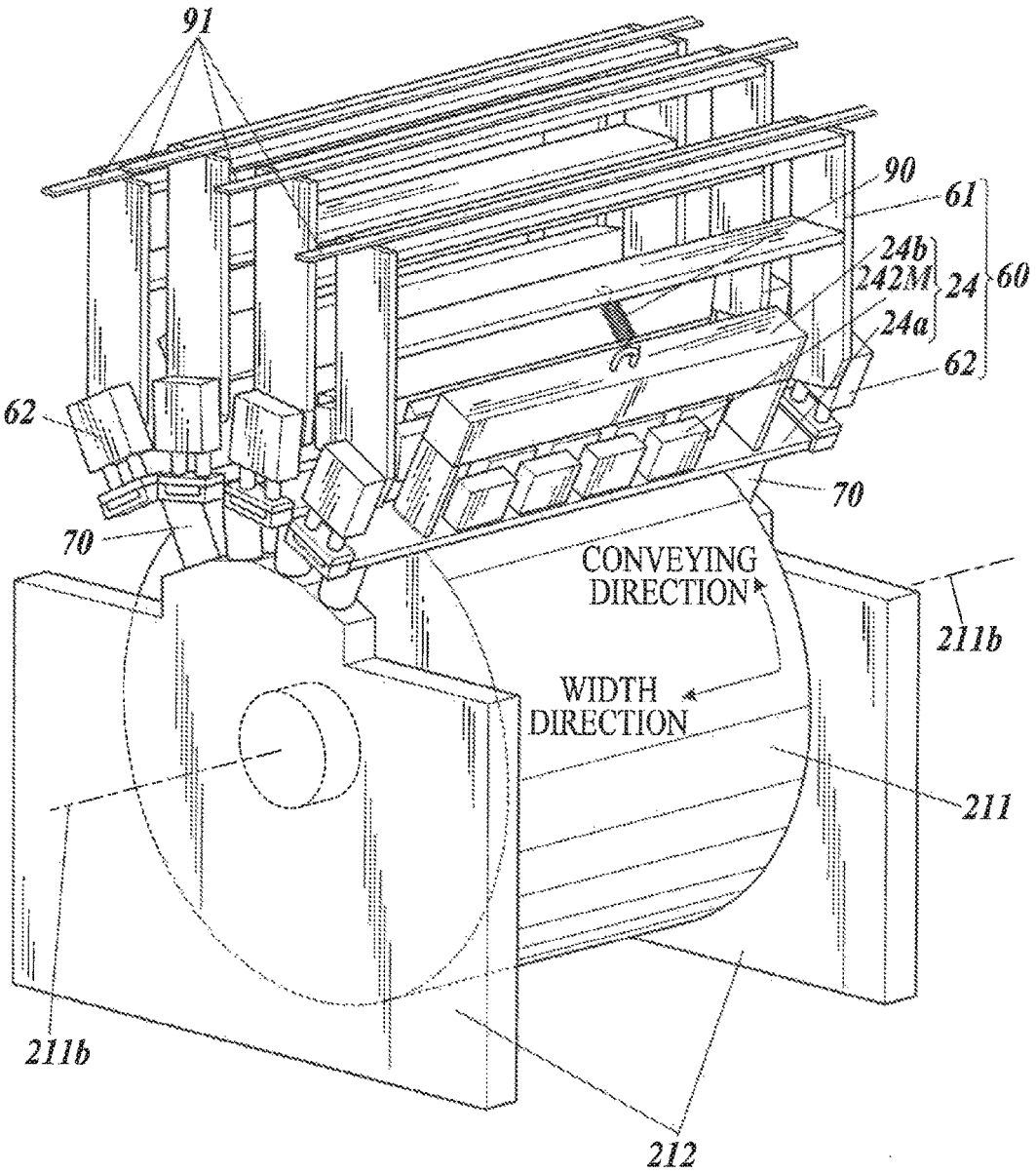
FIG. 4 is a schematic perspective view showing a structure around a conveyance drum and head units in an image former.

FIG. 4 is a schematic perspective view showing a structure around a conveyance drum 211 and head units 25 in the image former 20.

Figure 5:
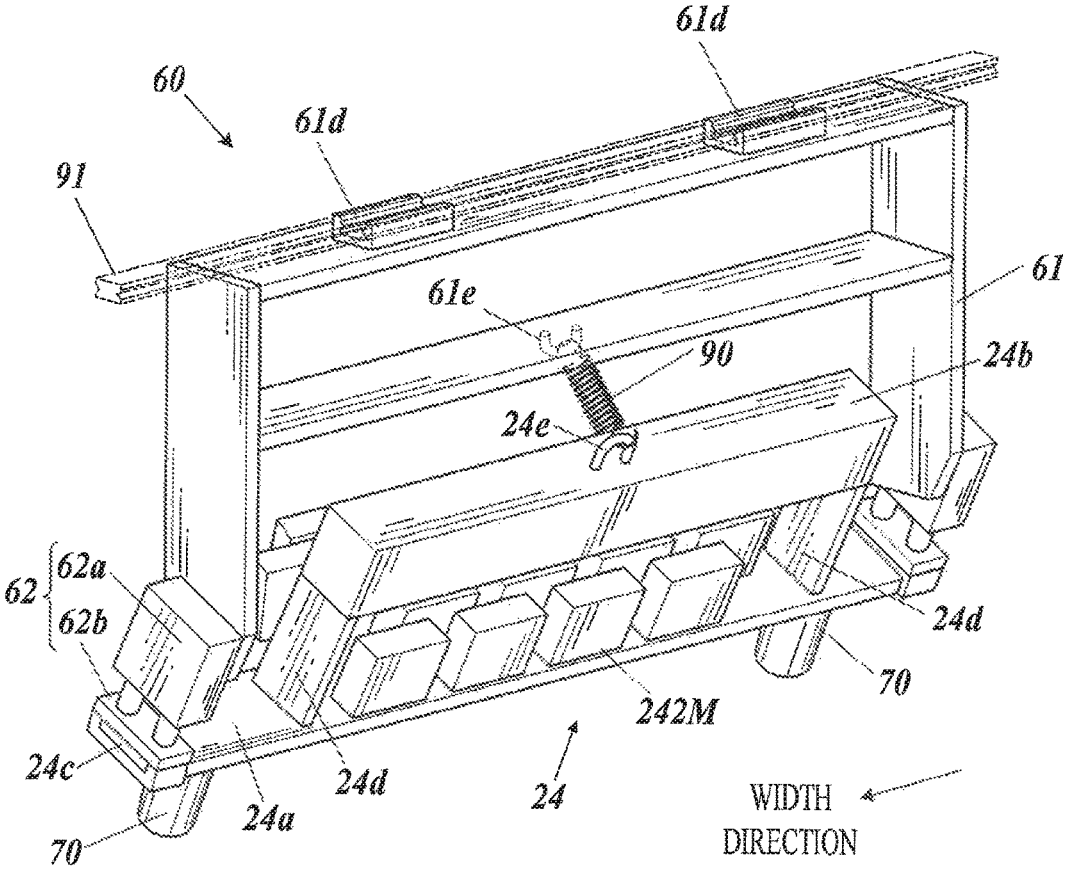
FIG. 5 is a schematic perspective view showing a structure of a carriage.

FIG. 5 is a schematic perspective view showing a structure of the carriage 60 including the head unit 24.

Figure 6:
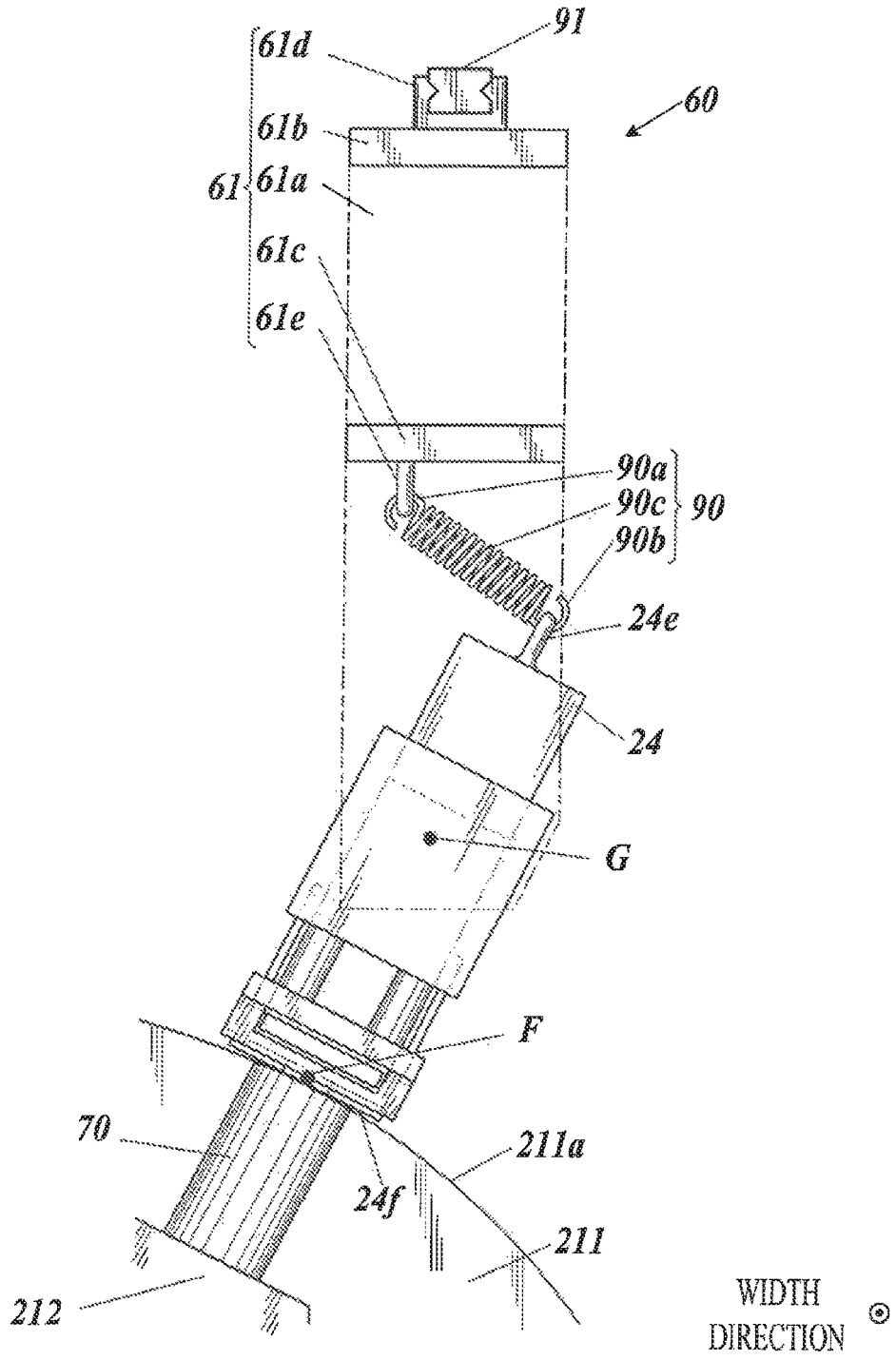
FIG. 6 is a schematic side view showing a structure of a carriage.

FIG. 6 is a schematic side view showing a structure of the carriage 60 including the head unit 24.

FIG. 4 shows the conveyance drum 211, a pair of attachment members 212 which is provided on both sides of the conveyance drum 211 and whose position relative to the cylindrical shaft 211*b* of the conveying drum 211 is fixed, four head units 24 each attached to the attachment members 212 via a pair of clamps 70 (a first fixing member, a second fixing member) so that the nozzle surface 24*f* faces the outer circumferential curved surface 211*a* of the conveyance drum 211, carriages 60 including the head units 24 and used for movement of the head units 24, and the like.

As shown in FIG. 4 to FIG. 6, the head units 24 each include a plate-shaped substrate 24*a* having a length in the width direction longer than the width of the outer circumferential curved surface 211*a*, eight head modules 242M engaged with openings formed in the substrate 24*a*, an upper case 24*b* extending in the width direction over the head modules 242M, and the like. The upper case 24*b* is supported by support plates 24*d* provided on both sides in the width direction of the eight head units 24 on the substrate 24*a*, and accommodates an ink tank 24*g* (FIG. 7B) and an ink heater inside. The nozzle surfaces 24*f* are exposed from the surface (the lower surface) of the substrate 24*a* not facing the upper case 24*b*. In the embodiment, the weight of the head units 24 is about 50 kg and the length in the width direction is about one meter.

The head units 24 are each fixed and attached to the pair of attachment members 212 by the clamps 70 which each fix the engaging portions 80 (FIG. 2 and FIG. 8) on the lower surface of the substrate 24*a* outside of the region facing the outer circumferential curved surface 211*a* of the conveying drum 211. The pair of engaging portions 80 is positioned on a line parallel to the cylindrical shaft 211*b*. The fixing mechanism of the head units 24 with the clamps 70 will be described later.

As shown in FIG. 5, tips 24*c* at both ends of the substrate 24*a* in the width direction are supported by a pair of air cylinders 62, and the pair of air cylinders 62 is fixed to the stay 61. The carriage 60 is constituted by the stay 61, the pair of air cylinders 62, and the head unit 24.

Figure 7A:
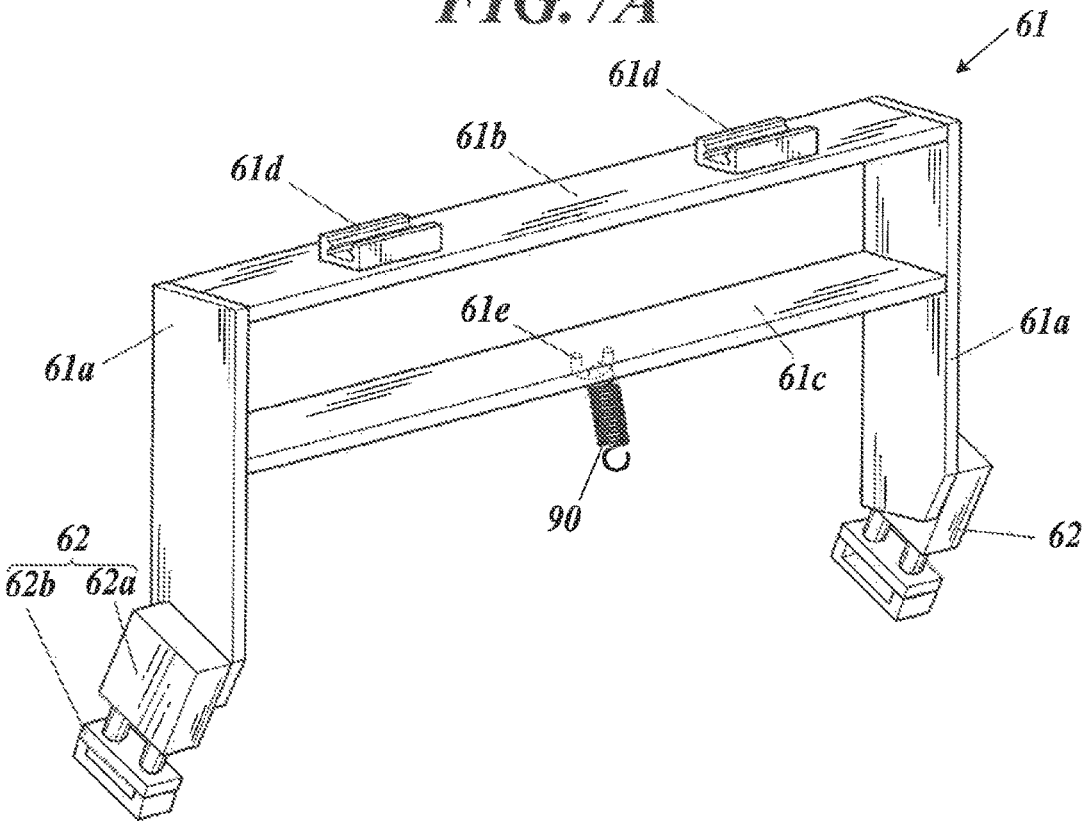
FIG. 7A is a schematic perspective view showing a structure of a stay and air cylinders in a carriage.
Figure 7B:
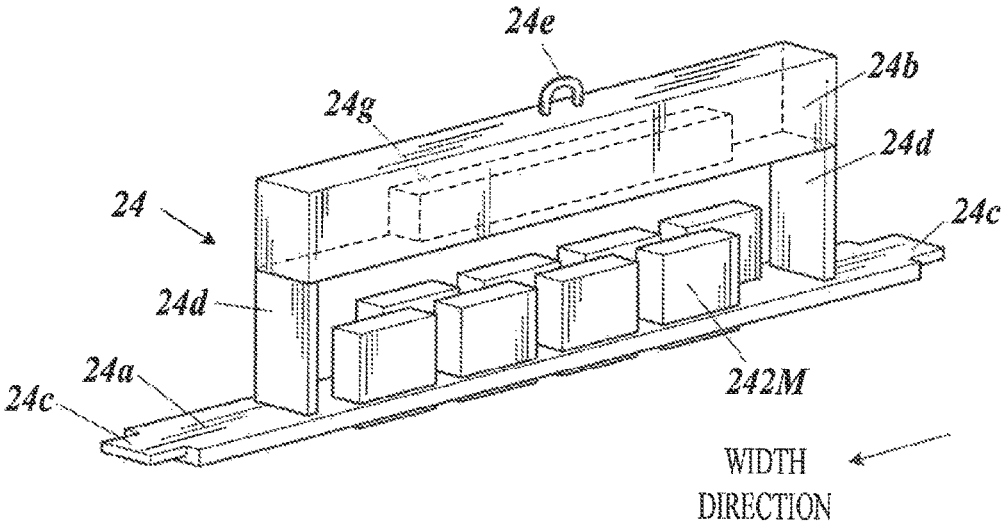
FIG. 7B is a schematic perspective view showing a structure of a head unit removed from air cylinders.

FIG. 7 are schematic perspective views showing structures of each component of the carriage 60. FIG. 7A shows a structure of the stay 61 and the air cylinders 62, and FIG. 7B shows a structure of the head unit 24 removed from the air cylinders 62.

As shown in FIG. 7A, the air cylinders 62 each have a base portion 62*a* fixed to the stay 61 and a lift portion 62*b* (combined member) moving up and down with respect to the base portion 62*a*, and support the substrate 24*a* in a state where each of the tips 24*c* of the substrate 24*a* is inserted into the opening formed in the lift portion 62*b*, so that the lift portion 62*b* and the substrate 24*a* are combined with each other. In a state where fixation of the head unit 24 by the clamps 70 is released, the air cylinders 62 move the head unit 24 in a direction away from the clamps 70 as the lift portions 62*b* move up. The air cylinders 62 move the head unit 24 to an attachment position to the clamps 70, as the lift portions 62*b* move down.

Here, the openings of the lift portions 62*b* and the tips 24*c* of the substrate 24*a* are not fixed to each other, so that the lift portions 62*b* do not apply force to the substrate 24*a* in a state where the head unit 24 is fixed to the clamps 70. That is, the lift portions 62*b* support the substrate 24*a* of the head unit 24 only in moving the head unit 24 in a state where fixation by the clamps 70 is released.

The stay 61 includes plate-like side frames 61*a* as a pair which extend in the vertical direction and to which the base portion 62*a* of the air cylinder 62 is each fixed, and an upper frame 61*b* and a lower frame 61*c* (frame members) which each extend in the width direction between the side frames 61*a* as a pair. On the upper surface of the upper frame 61*b* is provided a slide member(s) 61*d* via which the stay 61 is attached to the guide rail 91 (FIG. 4 to FIG. 6 and the like) extending in the width direction. The guide rail 91 is fixed to a not-shown frame member of the inkjet recording apparatus 1. With such a structure, the stay 61 is movable in the width direction as the slide member(s) 61*d* slides along the guide rail 91. That is, the entire carriage 60 is movable in the width direction in a state where the fixation of the head unit 24 by the clamps 70 is released and the head unit 24 is separated from the clamps 70. As a result, it is possible to move the head unit 24 to a predetermined maintenance position and to perform maintenance operations such as cleaning of the nozzle surfaces 24*f* and ejection of ink to prevent ink from thickening in the nozzles. In the present embodiment, the stay 61 and the air cylinders 62 constitute a holder for holding the head unit 24 in a state where fixation of the head unit 24 to the attachment members 212 is released.

A support member 90 including an elastic body links the U-shaped locking member 61*e* provided on the lower surface of the lower frame 61*c* of the stay 61 with the U-shaped locking member 24*e* provided on the upper surface of the upper case 24*b* of the head unit 24. The support member 90 of the present embodiment includes a metal spring 90*c* between a hook 90*a* (first portion) attached to the locking member 61*e* and a hook 90*b* (second portion) attached to the locking member 24*e*. The spring 90*c* links the locking member 61*e* and the locking member 24*e* in a state expanded from its natural state. Since the support member 90 can expand and contract as the head unit 24 moves up and down due to the air cylinders 62, the head unit 24 moves up and down while the support member 90 is attached. The purpose of providing the support member 90 and its operation will be described later.

Next, the fixing mechanism of the head unit 24 by the clamps 70 will be explained.

Figure 8A:
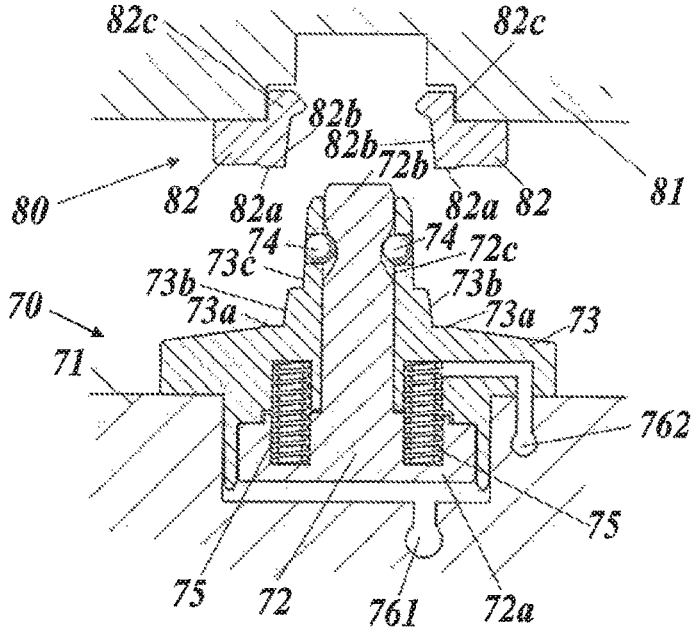
FIG. 8A is a view to explain fixing mechanism of a head unit by a clamp.

FIG. 8 are views to explain the fixing mechanism of the head unit 24 by the clamps 70. FIG. 8A shows one of the tips of the clamps 70 and one of the engaging portions 80 which is provided on the lower surface of the substrate 24*a* of the head unit 24.

The tip of the clamp 70 has a body part 71, a pull rod 72, a cover block 73, an engagement ball(s) 74, a clamp spring(s) 75, a release-air supply portion 761, a lock-air supply portion 762, and the like.

The pull rod 72 has a columnar rod portion 72*b* which extends upward from a base portion 72*a* in a recessed portion of the body part 71. Near the tip of the rod portion 72*b* is formed a groove 72*c* whose diameter gradually decreases.

The cover block 73 has a cylindrical guide 73*c* through which the rod portion 72*b* of the pull rod 72 passes. The cover block 73 is fixed to the body part 71 so as to cover the recessed portion of the body part 71 and the base portion 72*a* of the pull rod 72.

The engagement ball(s) 74 is a spherical member in a through hole(s) formed in the guide 73*c* of the cover block 73.

The clamp spring(s) 75 is housed in a housing unit composed of recessed portions facing each other, which are formed in the base portion 72*a* of the pull rod 72 and the cover block 73. The clamp spring(s) 75 applies elastic force to the pull rod 72 and to the cover block 73, to separate the pull rod 72 and the cover block 73 vertically in FIG. 8.

The pull rod 72 can move vertically in FIG. 8 in a space formed by the recessed portion of the main body 71 and the cover block 73. That is, the pull rod 72 moves upward in the above-described space when air is supplied from the release air supply portion 761 to the bottom of the recessed portion of the main body 71. When air supply from the release-air supply portion 761 is stopped and air is supplied from the lock-air supply portion 762 to the housing unit(s) of the clamp spring(s) 75, the pull rod 72 moves downward in the above-described space by the pressure of the air and the elastic force applied by the clamp spring(s) 75. Further, if the pull rod 72 has moved upward, the engagement ball(s) 74 is positioned at the groove 72*c*.

The engaging portion 80 has a housing 81 having a recessed portion in which the rod portion 72*b* of the pull rod 72 and the guide 73*c* of the cover block 73 are accommodated, and a fixing block 82 on the peripheral edge of the recessed portion of the housing 81.

The housing 81 is a member formed separately from the substrate 24*a*. The housing 81 is attached to the substrate 24*a* so that the position with respect to the substrate 24*a* in the vertical direction in FIG. 8A can be adjusted. With such a structure, it is possible to adjust the distance between the nozzle surface 24*f* and the outer circumferential curved surface 211*a* of the conveying drum 211 by adjusting the vertical position of the housing 81. Alternatively, the housing 81 may be formed by processing the substrate 24*a* of the head unit 24.

The inner periphery of the fixing block 82 forms a taper portion 82*b*. In a state where the clamp 70 is fixed to the engaging portion 80, the taper portion 82*b* abuts against a taper portion 73*b* formed by the outer peripheral surface of the guide 73*c* of the cover block 73. Further, in a state where the clamp 70 is fixed to the engaging portion 80, a flat seating surface 82*a* formed by the bottom surface of the fixing block 82 abuts against the flat reference surface 73*a* provided on the outer surface of the cover block 73. The fixing block 82 has a projecting portion 82*c* having an inner diameter smaller than that of the taper portion 82*b*.

Figure 8B:
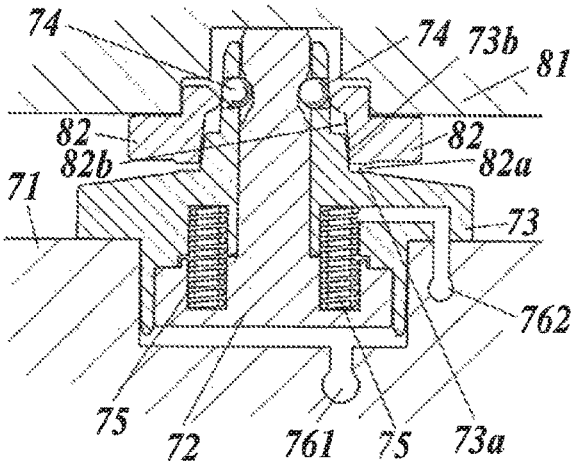
FIG. 8B is a view to explain fixing mechanism of a head unit by a clamp.

In order to fix the clamp 70 and the engaging portion 80, air is supplied from the release-air supply portion 761 so that the pull rod 72 moves upward as shown in FIG. 8B. The rod portion 72*b* of the pull rod 72 and the guide portion 73*c* of the cover block 73 are thereby housed in the recessed portion of the housing 81. At this time, since the engagement ball(s) 74 is positioned in the groove 72*c*, the engagement ball(s) 74 does not protrude from the guide 73*c* of the cover block 73. As a result, the engagement ball(s) 74 can pass the position of the projecting portion 82*c* of the fixing block 82 upward.

Figure 8C:
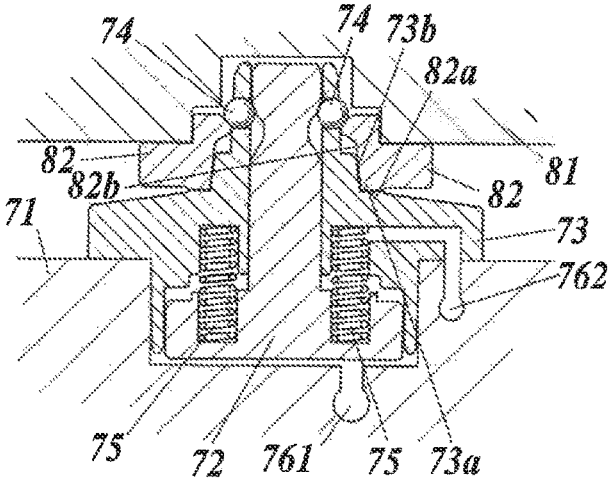
FIG. 8C is a view to explain fixing mechanism of a head unit by a clamp.

In this state, as shown in FIG. 8C, by stopping air supply from the release-air supply portion 761 and by starting air supply from the lock-air supply portion 762, the pull rod 72 is pulled down. As a result, the position of the groove 72*c* moves downward, and accordingly the engagement ball(s) 74 is pushed out to the outside of the guide 73*c* of the cover block 73. At this time, the engagement ball(s) 74 pushes the projecting portion 82*c* of the fixing block 82 downward, so that the engaging portion 80 is fixed to the clamp 70 at a position where the taper portion 82*b* abuts against the taper portion 73*b* and the seating surface 82*a* is pressed to and abuts against the reference surface 73*a*.

Figure 9:
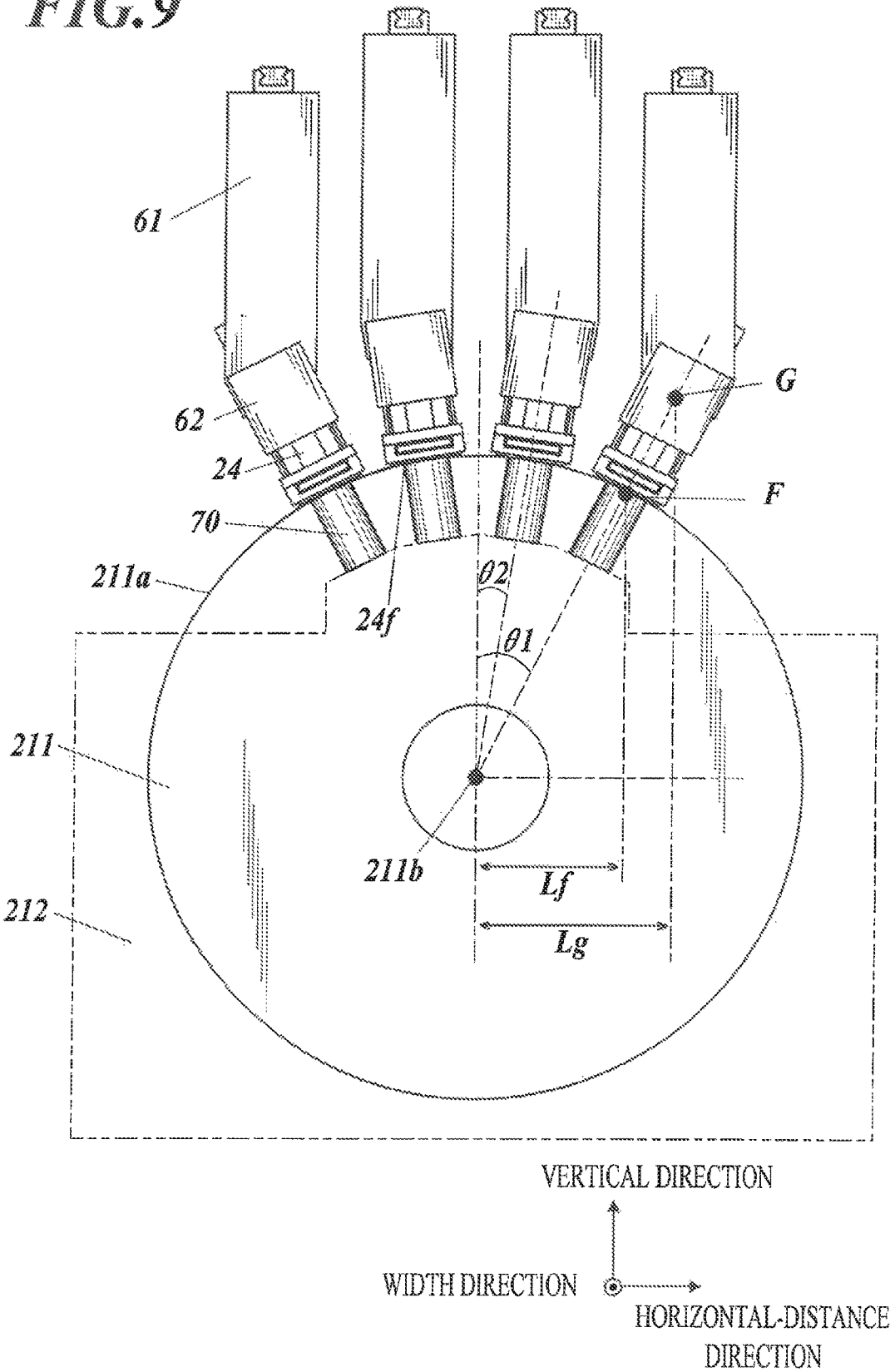
FIG. 9 is a schematic side view showing four head units fixed by clamps.

FIG. 9 is a schematic side view showing four head units 24 fixed by the clamps 70.

FIG. 10 are views showing the positional relationship between the nozzle surfaces 24*f* of the head units 24 and the outer circumferential curved surface 211*a* of the conveyance drum 211.

Figure 10A:
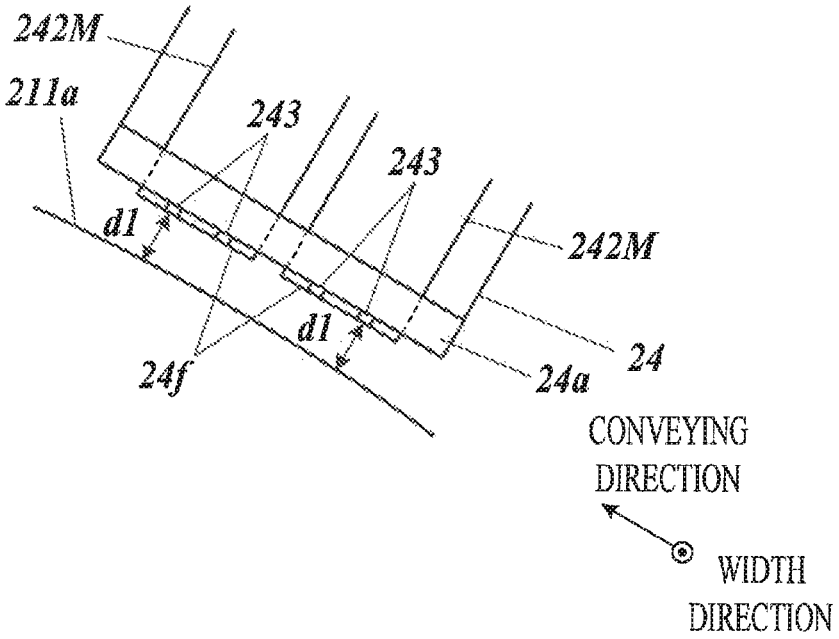
FIG. 10A is a view showing positional relationships between a nozzle surface of a head unit and an outer circumferential curved surface of a conveyance drum.

Each head unit 24 is fixed so that the nozzle surface 24*f* faces the outer circumferential curved surface 211*a* above the cylindrical shaft 211*b* in the vertical direction, in a predetermined positional relationship. Specifically, as shown in FIG. 10A, the head unit 24 is fixed so that distances d1 vary most slightly between the outer curved surface 211*a* and the openings of the respective nozzles 243 provided on the nozzle surface 24*f* at different positions in the conveying direction. Since the length of the nozzle surface 24*f* in the conveying direction is extremely small compared to the length of the outer circumference of the conveyance drum 211, the portion of the outer circumferential curved surface 211*a* facing the nozzle surface 24*f* can be approximated to a flat surface. Under such approximation, the head unit 24 is fixed in a state where the nozzle surface 24*f* and the outer peripheral curved surface 211*a* are in parallel (hereinafter referred to as a parallel state).

Here, as shown in FIG. 9, since the outer peripheral curved surface 211*a* of the conveyance drum 211 is a curved surface, the head unit 24 tilts with respect to the vertical direction and fixed according to the tilt angle of the position of the outer peripheral curved surface 211*a* where the nozzle surface 24*f* faces. For example, the head unit 24 on the rightmost side in FIG. 9 corresponding to Y is fixed in a state where the center axis tilts by an angle θ1 with respect to the vertical direction, while the center axis is perpendicular to the bottom surface on which the nozzle surface 24*f* and passes through the center of the bottom surface and the center of gravity G of the head unit 24. The second head unit 24 from the right corresponding to M is fixed in a state where the center axis tilts by an angle θ2 (<θ1) with respect to the vertical direction.

As a result, with respect to the horizontal-distance direction in FIG. 9, which is in the horizontal plane and perpendicular to the cylindrical shaft 211*b* of the conveyance drum 211, the distance Lg between the center of gravity G of the head unit 24 and the cylindrical shaft 211*b* is longer than the distance Lf between the fixing position F (the position where the engaging portion 80 is provided) fixed by the clamp 70 and the cylindrical shaft 211*b*. That is, the fixing position F is between the cylindrical shaft 211*b* and the center of gravity G in the horizontal-distance direction, and the center of gravity G and the fixing position F are shifted with respect to the horizontal-distance direction. Further, the fixing position F is located lower than the center of gravity G with respect to the vertical direction and closer to the cylindrical shaft 211*b* than the center of gravity G. By arranging the head unit 24 as described above, in the head unit 24 is generated a moment by gravity which rotates the head unit 24 with the fixing position F as a rotation center. As a result, depending on the fixation strength by the clamp 70, the entire head unit 24 in the above-described parallel state may tilt with the fixing position F as the center. Even when the fixation strength by the clamp 70 is sufficient, the head unit 24 may deflect at its intermediate portion of two fixing positions F in the width direction. The moment generated by gravity in the head unit 24 is represented by outer product of a position vector of the center of gravity G with the fixing position F as a starting point and a vector representing gravity acting on the head unit 24 in FIG. 9. In particular, in the present embodiment, since the heavy ink tank 24*g* is accommodated in the upper case 24*b* of the head unit 24, the position of the center of gravity G of the head unit 24 is high (that is, the above-described position vector is large), so that a large moment is generated by gravity in the head unit 24. Accordingly, above-described tilt and deflection of the head unit 24 are easily generated.

Figure 10B:
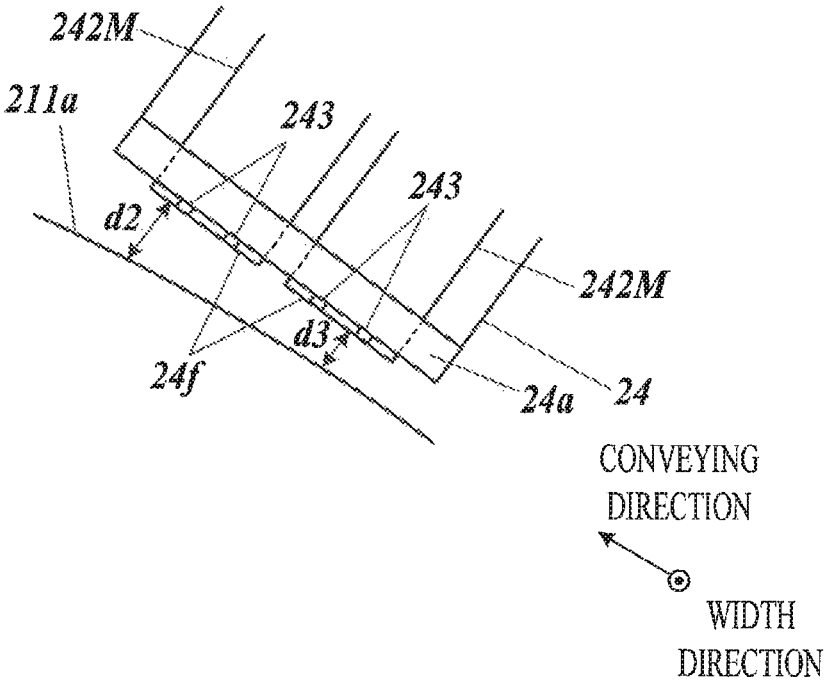
FIG. 10B is a view showing positional relationships between a nozzle surface and an outer circumferential curved surface of a conveyance drum if the head unit has tilted or deflected by gravity.

FIG. 10B is a view showing a positional relationship between each of the nozzle surfaces 24*f* and an outer circumferential curved surface 211*a* when the head unit 24 has tilted or deflected by gravity. As shown in this figure, when the head unit 24 tilts or deflects, the nozzle surfaces 24*f* and the outer circumferential curved surface 211*a* are in a non-parallel state, that is, in a state where the distances from the nozzle surfaces 24*f* and the outer peripheral curved surface 211*a* are different from each other depending on the positions of the nozzle surfaces 24*f* in the conveying direction. As a result, the distances from the openings of the nozzles 243 of the recording head 242 provided at different positions in the conveying direction to the outer circumferential curved surface 211*a* are different from each other, depending on the positions in the conveying direction. For example, while the distance from the nozzle opening of the nozzle 243 on the most downstream side in the conveying direction to the outer circumferential curved surface 211*a* is d2, the distance from the nozzle opening of the nozzle 243 on the most upstream side in the conveying direction to the outer circumferential curved surface 211*a* is d3, which is smaller than d2, in FIG. 10B. When the distances from the nozzle openings to the outer circumferential curved surface 211*a* are different from each other, the time until ink ejected from the nozzles 243 lands on the recording medium P on the outer circumferential curved surface 211*a* is different according to the above-described distance. As a result, ink does not land onto appropriate positions and the image quality of the recorded image is deteriorated.

Therefore, in the present embodiment, as illustrated in FIG. 5 and FIG. 6, the support member 90 including a metal spring 90*c* in an expanded state links the locking member 24*e* on the upper case 24*b* of the head unit 24 and the locking member 61*e* on the lower frame 61*c* of the stay 61. Tensile stress (restoring force) is generated in the spring 90*c* depending the force applied from the hook 90*a* and the hook 90*b*, and the support member 90 applies force to the lower frame 61*c* and the upper case 24*b* in a direction to reduce the relative distance therebetween. Here, since the position of the stay 61 which is attached to the guide rail 91 is fixed, the support member 90 applies force to the head unit 24 in a direction to pull up the head unit 24, which is a direction opposite to the rotation direction due to gravity. In this way, the support member 90 applies force in a direction to disturb rotation due to gravity to a position which is in the head unit 24 and farther from the cylindrical shaft 211*b* than the fixing position F, to support the head unit 24 and to suppress tilt and deflection of the head unit 24. As a result, the head unit 24 is fixed with the central axis tilting with respect to the vertical direction so as to be maintained in the above-described parallel state.

The intensity of the force applied by the support member 90 to the head unit 24 is adjusted so that the head unit 24 is maintained to be in the parallel state by the force. Such adjustment can be performed by changing the elastic body used in the support member 90 to one having a different vertical elastic modulus. For example, in the support members corresponding to the head units 24 attached to the attachment members 212 such that moment for inducing the rotation of the head units 24 due to gravity is larger, the elastic body having a larger vertical elastic modulus is used. In a support member 90 including a spring 90*c*, the strength of the force applied by the support member 90 to the head unit 24 can be adjusted by using a spring 90*c* having a different spring constant.

Furthermore, instead of or in addition to changing the elastic body of the support member 90, the strength of the force applied by the support member 90 to the head unit 24 can be adjusted by changing the expanding amount of the support member 90 from its natural state. For example, if the locking member 61*e* of the stay 61 shown in FIG. 6 is configured to be movable in the left and right direction in FIG. 6, the strength of tensile stress generated in the support member 90 can be adjusted by adjusting the position of the locking member 61*e*, that is, the fixing position to which the stay 61 side of the support member 90 is fixed via the hook 90*a*. The fixing position of the support member 90 may be manually adjusted by a person. Alternatively, a moving mechanism which moves the locking member 61*e* may be provided and controlled by the CPU 41 for adjusting the fixing position of the support member 90.

As described above, the inkjet recording apparatus 1 according to the present embodiment includes: the conveyance unit 21 having the cylindrical conveyance drum 211, on the outer circumferential curved surface 211*a* of which is placed the recording medium P, and conveying the recording medium P by rotation of the conveyance drum 211 around the cylindrical shaft 211*b*; the head unit 24 having nozzles 243 for ejecting ink onto the conveyed recording medium P; the attachment members 212 whose positions relative to the cylindrical shaft 211*b* are fixed and to which the head unit 24 is attached in a state where the outer circumferential curved surface 211*a* of the conveyance drum 211 faces the openings on the nozzle surfaces 24*f* across a predetermined relative distance, the openings of the nozzles 243 being formed on the nozzle surfaces 24*f* in the head unit 24; the clamps 70 for fixing the engaging portions 80 to the attachment members 212 in the head unit 24, while the engaging portions 80 are positioned between the center of gravity G of the head unit 24 and the cylindrical shaft 211*b* in the horizontal-distance direction in a horizontal plane and perpendicular to the cylindrical shaft 211*b*; and the support member 90 for supporting the head unit 24 fixed to the attachment members 212 by applying force to the head unit 24 in a direction for disturbing rotation of the head unit 24 due to gravity.

With such a structure, the support member 90 can suppress tilt or deflection of the head unit 24 due to gravity by supporting the head unit 24 in which the engaging portions 80 and the center of gravity G are shifted with respect to the horizontal-distance direction. As a result, it is possible to suppress fluctuation of distance from the nozzle surfaces 24*f* to the outer circumferential curved surface 211*a* of the conveying drum 211. This suppresses distance variation between the openings of the nozzles 243 and the outer peripheral curved surface 211*a* so that the time required for the ejected ink to land is equal for each of the nozzles 243. The ink thereby lands on proper positions and an image can be recorded with appropriate image quality.

Furthermore, the support member 90 supports the head unit 24 by applying force in a direction to disturb the above-described rotation to a position which is in the head unit 24 and farther from the cylindrical shaft 211*b* than the engaging portions 80. With such a structure, since the support member 90 supports the head unit 24 by applying force to a position in the head unit 24 closer to the center of gravity than the fixing position F on which the engaging portion 80 is provided, the deflection of the head unit due to gravity can be effectively suppressed.

Openings of multiple nozzles 243 are formed on the nozzle surface 24*f* over a predetermined recording width in the width direction (a cylinder axis direction). The inkjet recording apparatus 1 includes, in the head unit 24, the clamp 70 for fixing the engaging portion 80 located on one side of the arrangement range of the multiple nozzles 243 in the width direction to the attachment member 212. The inkjet recording apparatus 1 further includes, in the head unit 24, the clamp 70 for fixing the engaging portion 80 located on the other side of the arrangement range of the multiple nozzles 243 in the width direction to the attachment member 212. The support member 90 supports the head unit 24 by applying force to the position between the engagement portions 80 as a pair in the width direction of the head unit 24. With such a structure, it is possible to suppress occurrence of a malfunction, that is, fluctuation of the distance from the nozzle surface 24*f* to the outer circumferential curved surface 211*a* due to deflection of the head unit 24 at the central portion in the width direction by gravity.

The openings of the multiple nozzles 243 on the nozzle surface 24*f* face multiple different positions on the outer circumferential curved surface 211*a* in the conveying direction. With such a structure, when the nozzle surface 24*f* and the outer circumferential curved surface 211*a* are not in parallel due to the tilt or deflection of the head unit 24 by gravity, there occurs a malfunction, specifically, a variation in the distance from the opening of each of the multiple nozzles 243 at different positions in the conveying direction to the outer circumferential curved surface 211*a*. However, in the present embodiment, such a malfunction can be suppressed by supporting the head unit 24 by the support member 90.

The head unit 24 includes the recording heads 242 each having nozzle surfaces 24*f*, and the substrate 24*a* to which the recording heads 242 are fixed. The recording heads 242 are fixed to the substrate 24*a* with the nozzle surfaces 24*f* being exposed from one surface of the substrate 24*a*. The clamps 70 fix the engaging portions 80 provided on the above one surface of the substrate 24*a* to the attachment members 212. With such a structure, since the head unit 24 is fixed by the engaging portions 80 and the clamps 70 which are near the nozzle surface 24*f*, positional fluctuation of the nozzle surfaces 24*f* can be suppressed. With such a structure, since fixation of the head unit 24 is carried out at the portion nearest to the cylindrical shaft 211*b* in the head unit 24 or in the vicinity of the portion, the distance between the fixing position F and the center of gravity G is long. Therefore, the moment inducing rotation of the head unit 24 due to gravity is in increased, and the head unit 24 easily tilts and/or deflects. However, it is possible to effectively suppress the tilt and/or deflection by the support member 90 for supporting the head unit 24.

The head unit 24 has the upper case 24*b* provided on the opposite side of the above-described one surface of the substrate 24*a*. The support member 90 supports the head unit by applying force to the upper case 24*b*. With such a structure, the upper case 24*b* makes the distance between the fixing position F and the center of gravity G of the head unit 24 longer and thereby increases the moment for inducing rotation of the head unit 24 due to gravity, so that the head unit 24 tilts and/or deflects more easily. However, the support member 90 supporting the head unit 24 can effectively suppress the tilt and deflection.

In the upper case 24*b* is accommodated an ink tank 24*g* which stores ink to be supplied to the recording heads 242. With such a structure, the distance between the fixing position F and the center of gravity G of the head unit 24 becomes even longer, and thereby further increases the moment in the head unit 24. However, the support member 90 supporting the head unit 24 can effectively suppress the tilt and deflection of the head unit 24 due to the moment.

The relative position of the hook 90*a* as the first portion of the support member 90 is fixed with respect to the cylindrical shaft 211*b*, and the hook 90*b* as the second portion of the support member 90 is fixed to the head unit 24. The support member 90 supports the head unit 24 by tensile stress generated between the hook 90*a* and the hook 90*b*. With such a structure, since it is possible to support the head unit 24 by towing a portion far from the nozzle surface 24*f* in the head unit 24, it is possible to utilize the space near the side opposite to the nozzle surface 24*f* of the head unit 24 to provide the support member 90. Therefore, in the inkjet recording apparatus 1 including multiple head units 24, the multiple head units 24 can be arranged closer to each other, so that the inkjet recording apparatus 1 can be miniaturized.

Further, the inkjet recording apparatus 1 includes the stay 61 and the air cylinder(s) 62 (holder(s)) which can hold the head unit 24 at a predetermined relative position with respect to the cylindrical shaft 211*b* at least in a state where fixation of the head unit 24 to the attachment member(s) 212 by the clamp(s) 70 is released. The hook 90*a* of the support member 90 is attached to the stay 61. More specifically, the lift portion(s) 62*b* of the air cylinder(s) 62 is combined with the substrate 24*a*; the lower frame 61*c* of the stay 61 is integrally provided with the air cylinder(s) 62 and is located above the upper case 24*b* in the vertical direction; the stay 61 and the air cylinder(s) 62 can hold the head unit 24 at a predetermined relative position with respect to the cylindrical shaft 211*b* by the lift portion(s) 62*b* of the air cylinder(s) 62 supporting the substrate 24*a*, at least in a state where fixation of the head unit 24 by the clamp(s) 70 to the attachment members 212 is released; the hook 90*a* of the support member 90 is fixed to the lower frame 61*c* of the stay 61 and the hook 90*b* of the support member 90 is fixed to the upper case 24*b*; and the support member 90 supports the head unit 24 by the tensile stress generated between the hook 90*a* and hook 90*b*.

With such a structure, the support member 90 can be attached not by providing a dedicated member for fixing the hook 90*a* of the support member 90 but by using members for holding the head unit 24. As a result, increase in the cost and size of the inkjet recording apparatus 1 can be suppressed. Further, the head unit 24 can be fixed to and released from the attachment member(s) 212 without removing the support member 90 from the head unit 24 and the stay 61.

The support member 90 includes the elastic body which generates tensile stress depending on the force applied from the hook 90*a* and the hook 90*b*. With such a structure, even when fluctuation due to the up-and-down movement of the head unit 24 by the air cylinders 62 is caused regarding the relative position between the member to which the hook 90*a* of the support member is attached (the stay 61 in the above embodiment) and the head unit 24 to which the hook 90*b* of the support member is attached, the support member 90 can expand and contract in accordance with the up-and-down movement. Accordingly, the relative position can be fluctuated without removing the support member 90.

Furthermore, the inkjet recording apparatus 1 includes multiple head units 24 and multiple support members 90 respectively corresponding to the multiple head units 24. An elastic body having a larger vertical elastic modulus is used in a support member 90 among the multiple support members 90 which corresponds to a head unit 24 attached to the attachment member(s) 212 such that the moment for inducing rotation of the head unit 24 is larger. As a result, if the support member 90 includes an elastic body, the tilt and deflection of the head unit 24 due to gravity can be appropriately suppressed depending on an attachment angle of the head unit 24 with respect to the attachment member(s) 212.

The present invention is not limited to the embodiment and the modification example described above, and various changes can be made thereto.

For example, in the embodiment described above, the support member 90 includes a metal spring 90*c*. However, the support member 90 may be constituted using another elastic member including, for example, a resin, a carbon fiber material, or the like. The support member 90 may include a member such as a cable made of a material having no or very small elasticity such as a metal, a carbon steel, or the like.

Further, in the embodiment described above, one end of the support member 90 is attached to the stay 61 constituting the carriage 60, but this should not be construed as limiting the present invention. The support member 90 may be attached to another member whose relative position is fixed with respect to the cylindrical shaft 211*b* of the conveyance drum 211 in the inkjet recording apparatus 1, for example, to the frame member supporting the components of the inkjet recording apparatus 1.

Further, in the embodiment described above, the other end of the support member 90 is attached to the upper surface of the upper case 24*b* of the head unit 24, but this should not be construed as limiting the present invention. The other end of the support member 90 may be attached to any position, as long as force can be applied to the head unit 24 in a direction for disturbing rotation of the head unit 24 due to gravity.

Further, in the embodiment described above, the one end and the other end of the support member 90 are detachably fixed to the locking members 61*e* and 24*e*, respectively by the hooks 90*a* and 90*b*. However, this should not be construed as limiting the fixing manner of the one end and the other end of the support member 90. For example, the one end and the other end of the support member 90 may be firmly fixed to members of fixation targets in another detachable manner or may be firmly fixed to members of fixation targets by adhesion or welding.

The portions fixed to the members of fixation targets in the support member 90 are not limited to be ends of the support member 90. For example, two different portions between one end and the other end of a spring constituting the support member 90 may be fixed to members of fixation targets. With such a structure, it is also possible to adjust the strength of tensile stress generated in the support member 90 by changing the distance between the two portions to be fixed.

Further, in the embodiment described above, the support member 90 is attached to one center portion in the width direction of the upper case 24*b* of the head unit 24. However, two or more support members 90 may be attached to one head unit 24.

Further, in the embodiment described above, the support member 90 supports the head unit 24 by towing. However, instead of or in addition to such a support member 90, a support member 90 which supports the head unit 24 in the vertical direction from the bottom side may be used. With such a structure, the head unit 24 can be supported by, for example, a spring which abuts to the head unit 24 in a compressed state from its natural state.

Further, in the embodiment described above, the support member 90 directly contacts the head unit 24 to apply force to the head unit 24. However, the support member may apply magnetic force to the head unit 24 without contacting the head unit 24, for example.

In the embodiment described above, two fixing positions F are on a line parallel to the cylindrical shaft 211*b* when the head unit 24 is fixed. Alternatively, the line through the fixing positions F may not be parallel to the cylindrical shaft 211*b* when the head unit 24 is fixed. Furthermore, when the head unit 24 is fixed, the fixing positions F (that is, the positions of the fixing portions) of the head unit 24 may be between the center of gravity G and the cylindrical shaft 211*b* in the horizontal-distance direction in another manner.

The fixing mechanism of the head unit 24 is not limited to include the clamp(s) 70 as in the embodiment described above, but may include a bolt(s) and a nut(s). Further, the head unit 24 is not limited to be fixed at the two positions near both ends in the width direction of the bottom surface, but may be fixed at one position or three or more positions. Further, the position(s) fixed to the attachment member(s) 212 may be on the bottom surface of the head unit 24 (in the above embodiment, the lower surface of the substrate 24*a*).

Further, in the embodiment described above, the head unit 24 is detachably fixed to the attachment member(s) 212 via the clamp(s) 70. Alternatively, the present invention may be applied to an inkjet recording apparatus in which the relative position of the head unit and the cylindrical shaft of the conveyance dram is stationary fixed.

Further, the head unit is not limited to have the structure described in the above embodiment, but may have any other structures including a member (in the above embodiment, the recording heads 242) having integrally formed nozzle surface(s). For example, the head unit may have a structure including not the member corresponding to the upper case 24*b* in the above embodiment, but a substrate on which the recording heads are fixed, a frame integrally formed with the substrate, and the like. Alternatively, the head unit may not be provided with ink tank(s) but may have a configuration in which ink is supplied to the recording head from outside of the head unit. Further, in the embodiment described above, the center of gravity G of the head unit 24 is on the center axis passing through the center of the bottom surface of the head unit 24 and being perpendicular to the bottom surface. However, the center of gravity G of the head unit may not pass through the center axis.

Further, in the embodiment described above, multiple nozzles 243 are provided at different positions in the conveying direction of the head unit 24. However, the head unit 24 may have a single nozzle array including multiple nozzles provided at the same position in the conveying direction.

Further, in the embodiment described above, the nozzle surface 24*f* of the head unit 24 faces the outer peripheral curved surface 211*a* of the conveyance dram 211 above the cylindrical shaft 211*b* in the vertical direction. However, the present invention may be applied to an inkjet recording apparatus in which the nozzle surface 24*f* of the head unit 24 faces the outer peripheral curved surface 211*a* of the conveyance dram 211 lower than the cylindrical shaft 211*b* in the vertical direction.

Further, in the embodiment described above, the cylindrical shaft 211*b* of the conveyance dram 211 is in a horizontal plane. However, the cylindrical shaft 211*b* may be inclined to the horizontal plane, as long as ink ejected from the head unit 24 can land onto appropriate positions of the recording medium P on the outer circumferential curved surface 211*a*.

Further, in the inkjet recording apparatus 1 according to the embodiment described above, the ink which is in a gel state at room temperature and becomes a sol state by heating is heated into a sol state for ejection, but this should not be construed as limiting the present invention. A variety of known inks may be used, including an ink which is in a sol state or liquid at room temperature.

According to the present invention, it is possible to suppress fluctuation of the distance from the nozzle surface to the outer circumferential curved surface of the conveyance drum.

Although some embodiments of the present invention are described, the scope of the present invention is not limited to the embodiments described above, but includes the scope of claims and the scope of their equivalents.

Although embodiments of the present invention have been described and illustrated in detail, the disclosed embodiments are made for purposes of illustration and example only and not limitation. The scope of the present invention should be interpreted by terms of the appended claims.

INDUSTRIAL APPLICABILITY

The present invention is applicable to an inkjet recording apparatus.

DESCRIPTION OF REFERENCE NUMERALS

1 Inkjet Recording Apparatus
2 External Device
10 Sheet Feeder
20 Image Former
21 Conveyance Unit
211 Conveyor Drum
211*a* Outer Circumferential Curved Surface
211*b* Cylindrical Shaft
212 Attachment Member
22 First Delivery Unit
23 Heater
24 Head Unit
24*a* Substrate
24*b* Upper Case
24*c* Tip
24*d* Support Plate
24*e* Locking Member
24*f* Nozzle Surface
24*g* Ink Tank
241 Recording Head Drive Unit
242 Recording Head
242M Head Module
243 Nozzle
25 Fixing Unit
26 Second Delivery Unit
30 Sheet Receiver
40 Controller
41 CPU
42 RAM
43 ROM
44 Storage
51 Conveyance Drive Unit
52 Input-Output Interface
53 bus
60 Carriage
61 Stay
61*a* Side Frame
61*b* Upper Frame
61*c* Lower Frame
61*d* SLIDE Member
61*e* Locking Member
62 Air Cylinder
70 Clamp
80 Engaging Portion
90 Support Member
91 Guide Rail
F Fixing Position
G Center Of Gravity
P Recording Medium

The invention claimed is:

1. An inkjet recording apparatus comprising:

a conveyance unit which has a cylindrical conveyance drum on an outer circumferential curved surface of which is mounted a recording medium, and conveys the recording medium by rotation of the conveyance drum around a cylindrical shaft;

a head unit which has a nozzle ejecting ink onto the recording medium which is conveyed;

an attachment member whose relative position to the cylindrical shaft is fixed and to which the head unit is attached such that the outer circumferential curved surface of the conveyance drum faces an opening across a predetermined relative distance, the opening of the nozzle being formed on a nozzle surface in the head unit;

a fixing member which fixes a fixing portion in the head unit to the attachment member, the fixing portion being positioned between a center of gravity of the head unit and the cylindrical shaft in a direction which is in a horizontal plane and perpendicular to the cylindrical shaft; and a support member which applies force to the head unit fixed to the attachment member and supports the head unit, the force being in a direction to disturb rotation of the head unit due to gravity, wherein the support member applies the force to a position of the head unit farther from the cylindrical shaft than the fixing portion in a direction to disturb rotation, and supports the head unit.

2. The inkjet recording apparatus according to claim 1, wherein the nozzle includes multiple nozzles, and the nozzle surface is provided with openings of the respective multiple nozzles over a predetermined recording width in a cylindrical shaft direction along the cylindrical shaft, and wherein the openings of the multiple nozzles face multiple positions on the outer circumferential curved surface, the positions being different in a conveying direction of a recording medium.

3. The inkjet recording apparatus according to claim 1, wherein the head unit comprises:

a recording head which has the nozzle surface; and a substrate to which the recording head is fixed, wherein the recording head is fixed to the substrate in a state where the nozzle surface is exposed from one surface of the substrate, and wherein the fixing member fixes the fixing portion provided on the one surface of the substrate to the attachment member.

4. An inkjet recording apparatus comprising:

a conveyance unit which has a cylindrical conveyance drum on an outer circumferential curved surface of which is mounted a recording medium, and conveys the recording medium by rotation of the conveyance drum around a cylindrical shaft;

a head unit which has a nozzle ejecting ink onto the recording medium which is conveyed;

an attachment member whose relative position to the cylindrical shaft is fixed and to which the head unit is attached such that the outer circumferential curved surface of the conveyance drum faces an opening across a predetermined relative distance, the opening of the nozzle being formed on a nozzle surface in the head unit;

a fixing member which fixes a fixing portion in the head unit to the attachment member, the fixing portion being positioned between a center of gravity of the head unit and the cylindrical shaft in a direction which is in a horizontal plane and perpendicular to the cylindrical shaft; and a support member which applies force to the head unit fixed to the attachment member and supports the head unit, the force being in a direction to disturb rotation of the head unit due to gravity, wherein the nozzle includes multiple nozzles, and the nozzle surface is provided with openings of the respective multiple nozzles over a predetermined recording width in a cylindrical shaft direction along the cylindrical shaft, wherein the fixing member includes a first fixing member and a second fixing member and the fixing portion includes a first fixing portion and a second fixing portion, wherein the first fixing member fixes the first fixing portion in the head unit to the attachment member, the first fixing portion being positioned on one side of an arrangement range of the multiple nozzles in the cylindrical shaft direction, wherein the second fixing member fixes the second fixing portion in the head unit to the attachment member, the second fixing portion being positioned on another side of the arrangement range of the multiple nozzles in the cylindrical shaft direction, and wherein the support member applies force in the cylindrical shaft direction to a position of the head unit between the first fixing portion and the second fixing portion and supports the head unit.

5. The inkjet recording apparatus according to claim 4, wherein the support member applies the force to a position of the head unit farther from the cylindrical shaft than the fixing portion in a direction to disturb rotation, and supports the head unit.

6. An inkjet recording apparatus comprising:

a conveyance unit which has a cylindrical conveyance drum on an outer circumferential curved surface of which is mounted a recording medium, and conveys the recording medium by rotation of the conveyance drum around a cylindrical shaft;

a head unit which has a nozzle ejecting ink onto the recording medium which is conveyed;

an attachment member whose relative position to the cylindrical shaft is fixed and to which the head unit is attached such that the outer circumferential curved surface of the conveyance drum faces an opening across a predetermined relative distance, the opening of the nozzle being formed on a nozzle surface in the head unit;

a fixing member which fixes a fixing portion in the head unit to the attachment member, the fixing portion being positioned between a center of gravity of the head unit and the cylindrical shaft in a direction which is in a horizontal plane and perpendicular to the cylindrical shaft; and a support member which applies force to the head unit fixed to the attachment member and supports the head unit, the force being in a direction to disturb rotation of the head unit due to gravity, wherein the head unit comprises:

a recording head which has the nozzle surface; and a substrate to which the recording head is fixed, wherein the recording head is fixed to the substrate in a state where the nozzle surface is exposed from one surface of the substrate, wherein the fixing member fixes the fixing portion provided on the one surface of the substrate to the attachment member, wherein the head unit comprises a case provided on a surface of the substrate which is opposite to the one surface, and wherein the support member applies force to the case and supports the head unit.

7. The inkjet recording apparatus according to claim 6, wherein the case accommodates an ink tank which stores ink to be supplied to the recording head.

8. The inkjet recording apparatus according to claim 6 comprising:

a holder comprising:

a combined member which is combined with the substrate; and a frame member which is integrally provided with the combined member and located above the case in the vertical direction, wherein, by supporting the substrate with the combined member, the holder can hold the head unit at a predetermined relative position with respect to the cylindrical shaft at least in a state where fixation of the head unit to the attachment member by the fixing member is released, and wherein the support member has a first portion and a second portion, a relative position of the first portion with respect to the cylindrical shaft being fixed by fixation to the frame member of the holder, and the second portion being different from the first portion and fixed to the case, and wherein the support member supports the head unit by tensile stress generated between the first portion and the second portion.

9. An inkjet recording apparatus comprising:

a conveyance unit which has a cylindrical conveyance drum on an outer circumferential curved surface of which is mounted a recording medium, and conveys the recording medium by rotation of the conveyance drum around a cylindrical shaft;

a head unit which has a nozzle electing ink onto the recording medium which is conveyed;

an attachment member whose relative position to the cylindrical shaft is fixed and to which the head unit is attached such that the outer circumferential curved surface of the conveyance drum faces an opening across a predetermined relative distance, the opening of the nozzle being formed on a nozzle surface in the head unit;

a fixing member which fixes a fixing portion in the head unit to the attachment member, the fixing portion being positioned between a center of gravity of the head unit and the cylindrical shaft in a direction which is in a horizontal plane and perpendicular to the cylindrical shaft; and a support member which applies force to the head unit fixed to the attachment member and supports the head unit, the force being in a direction to disturb rotation of the head unit due to gravity, wherein the support member has a first portion and a second portion, a relative position of the first portion with respect to the cylindrical shaft being fixed, and the second portion being different from the first portion and fixed to the head unit, and wherein the support member supports the head unit by tensile stress generated between the first portion and the second portion.

10. The inkjet recording apparatus according to claim 9 comprising:

a holder which can hold the head unit at a predetermined relative position with respect to the cylindrical shaft at least in a state where fixation of the head unit to the attachment member by the fixing member is released, wherein the first portion is attached to the holder.

11. The inkjet recording apparatus according to claim 9, wherein the support member includes an elastic body which generates the tensile stress depending on force applied from the first portion and the second portion.

12. The inkjet recording apparatus according to claim 11, wherein the head unit includes multiple head units, wherein the support member includes multiple support members corresponding to the multiple head units, and wherein, in the multiple support members corresponding to the head units attached to the attachment member such that moment for inducing the rotation of the head units due to gravity is larger, the elastic body having a larger vertical elastic modulus is used.

* * * * *